US009062865B2

(12) United States Patent
Wang et al.

(10) Patent No.: US 9,062,865 B2
(45) Date of Patent: Jun. 23, 2015

(54) HOUSING AND LIGHT EMITTING DEVICE HAVING THE SAME

(71) Applicant: Leotek Electronics Corporation, Taoyuan Hsien (TW)

(72) Inventors: Shih-Chang Wang, Taoyuan Hsien (TW); Po-Chang Li, Taoyuan Hsien (TW); Ming-Chih Lai, Taoyuan Hsien (TW); Pin-Hao Hsu, Taoyuan Hsien (TW)

(73) Assignee: Lite-On Technology Corporation (CN)

( * ) Notice: Subject to any disclaimer, the term of this patent is extended or adjusted under 35 U.S.C. 154(b) by 107 days.

(21) Appl. No.: 13/728,543

(22) Filed: Dec. 27, 2012

(65) Prior Publication Data

US 2013/0235595 A1 Sep. 12, 2013

Related U.S. Application Data

(60) Provisional application No. 61/608,669, filed on Mar. 9, 2012.

(51) Int. Cl.

| | |
|---|---|
| ***F21V 29/00*** | (2015.01) |
| ***F21V 23/04*** | (2006.01) |
| ***F21V 29/507*** | (2015.01) |
| *F21W 131/10* | (2006.01) |
| *F21Y 101/02* | (2006.01) |
| *F21V 29/89* | (2015.01) |

(52) U.S. Cl.

CPC ..... *F21V 29/004* (2013.01); *F21V 29/20* (2013.01); *F21V 23/0464* (2013.01); *F21W 2131/10* (2013.01); *F21Y 2101/02* (2013.01); *F21V 29/507* (2015.01); *F21V 29/89* (2015.01)

(58) Field of Classification Search

CPC ..... F21Y 2101/02; F21Y 2105/001; F21Y 2111/002; F21Y 2113/005; F21V 29/004; F21V 29/006; F21V 29/2293; F21V 9/02; F21V 29/2262; F21V 29/2206; F21V 15/01; F21S 48/328

USPC ..... 362/373

See application file for complete search history.

(56) References Cited

U.S. PATENT DOCUMENTS 7,637,638 B2 * 12/2009 Chen ..... 362/294
7,841,756 B2 * 11/2010 Kracker et al. ..... 362/505

(Continued)

FOREIGN PATENT DOCUMENTS

CN 101701690 5/2010
TW 343121 10/2008

(Continued)

OTHER PUBLICATIONS

Taiwanese Search Report dated Feb. 4, 2015 issued in counterpart application No. 10420159770.

*Primary Examiner* — Mary Ellen Bowman
(74) *Attorney, Agent, or Firm* — The Farrell Law Firm, P.C.

(57) ABSTRACT

A housing of light emitting device including a first part for accommodating a light emitting diode module and providing a space for heat dissipation is disclosed. The first part includes an outline casing forming an enclosed room and at least one heat conductive structure disposed inside the enclosed room. The heat conductive structure couples to a heat dissipating side and a light emitting side of the outline casing.

24 Claims, 2 Drawing Sheets

(56) References Cited

U.S. PATENT DOCUMENTS

| | | | | |
|---|---|---|---|---|
| 2010/0315824 | A1* | 12/2010 | Chen | 362/373 |
| 2011/0285267 | A1* | 11/2011 | Lu et al. | 313/46 |
| 2011/0286219 | A1* | 11/2011 | Guercio et al. | 362/294 |

FOREIGN PATENT DOCUMENTS

| | | |
|---|---|---|
| TW | 391055 | 10/2010 |
| TW | 201043845 | 12/2010 |
| TW | 422036 | 2/2012 |

* cited by examiner

HOUSING AND LIGHT EMITTING DEVICE HAVING THE SAME

This application claims the benefit of U.S. provisional application Ser. No. 61/608,669, filed Mar. 9, 2012, the subject matter of which is incorporated herein by reference.

BACKGROUND OF THE INVENTION

1. Field of the Invention

The invention relates in general to housing and a light emitting device having the same, and more particularly to a housing with good heat dissipation efficacy and a light emitting device having the same.

2. Description of the Related Art

Currently, light emitting diode (LED) lamp has replaced the traditional fluorescent bulb lamp for some advantages such as higher lifespan, lower power consumption and smaller size. A LED lamp requires a light housing for fixing and protecting the LEDs. The heat dissipating efficacy of the light housing is important since the LEDs can be damaged by the thermal generating from the LEDs. Typically, a heat spreader is disposed on the heat dissipating side of the light housing for promoting the heat dissipating efficacy of the light housing.

In one type of the conventional LED lamp on street, heat spreader is exposed to the outside. This exposed heat spreader increases the surface area of the heat dissipating surface on the housing of the LED lamp, and remains the light emitting surface of the LED lamp at relatively low temperature when the high power LEDs on the light emitting surface of the LED lamp are working. However, the dust and sand are easily deposited on the gap of the exposed heat spreader.

FIG. 1A~1B show a diagram illustrating another conventional housing of a LED lamp. Another type of the conventional LED lamp 2 utilizes an existing shell 20 of light lamp for covering and encircling the heat spreader 22 to protect the heat spreader 22 from sand and dust. This type of LED lamp put the heat spreader 22 instead of the traditional light bulb (not shown) inside the existing shell 20 of light lamp. However, heat dissipating efficacy of the LED lamp 2 is unsatisfactory for the market requirements, since a large amount of the heat air surrounding the heat spreader 22 are also encircled in the existing shell 20 of light lamp, and the large amount of heat air in this existing shell 20 of light lamp is against the object of heat dissipating.

SUMMARY OF THE INVENTION

Therefore, the present invention relates to a housing and a light emitting device having the same with excellent heat dissipation efficacy and dust-proof structure.

According to a first aspect of the present invention, a housing of light emitting device including a first part for accommodating a light emitting diode module and providing a space for heat dissipation is disclosed. The first part includes an outline casing forming an enclosed room and at least one heat conductive structure disposed inside the enclosed room. The heat conductive structure couples to a heat dissipating side and a light emitting side of the outline casing.

According to a second aspect of the present invention, a light emitting device including a light emitting diode module and a housing covering the light emitting diode module is disclosed. The light emitting diode module is used for providing light. The housing includes a first part including an outline casing forming an enclosed room and at least one heat conductive structure disposed inside the enclosed room. The heat conductive structure couples to a heat dissipating side and a light emitting side of the outline casing.

DETAILED DESCRIPTION OF THE INVENTION

Figure 1A:
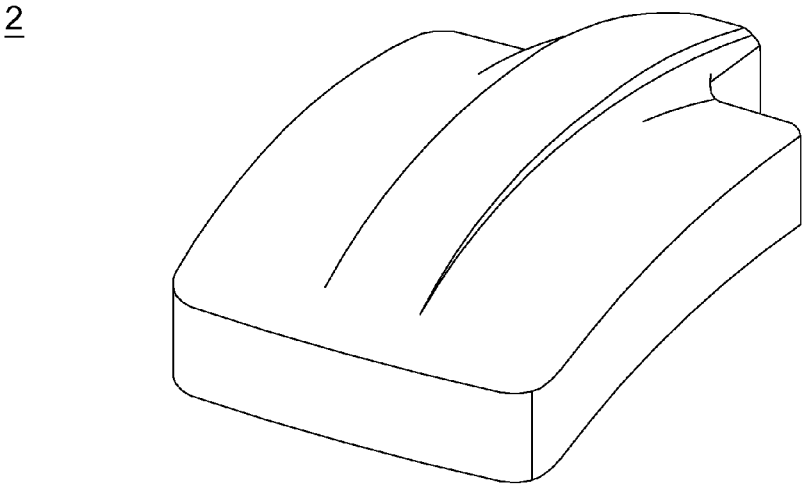
FIG. 1A (Prior Art)
FIG. 1A-1B show a diagram illustrating a conventional housing of a LED lamp.
Figure 1B:
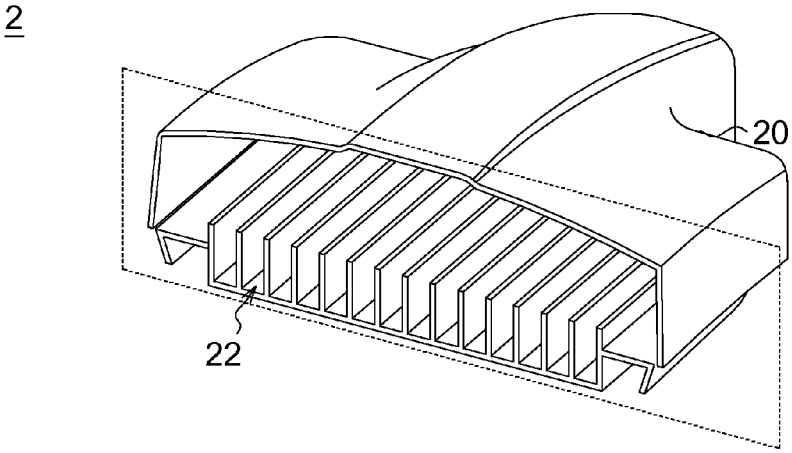
FIG. 1B (Prior Art)
Figure 2A:
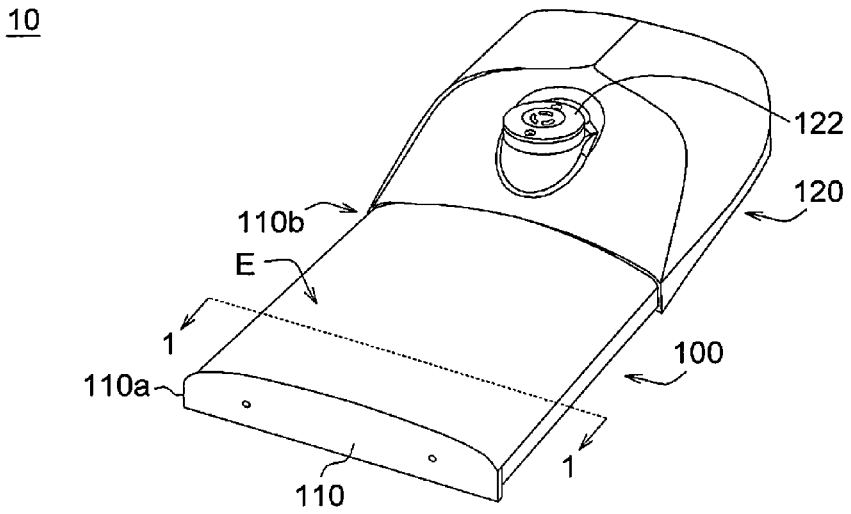
FIG. 2A shows a diagram illustrating a housing of a light emitting device according to an embodiment of the present invention.
Figure 2B:
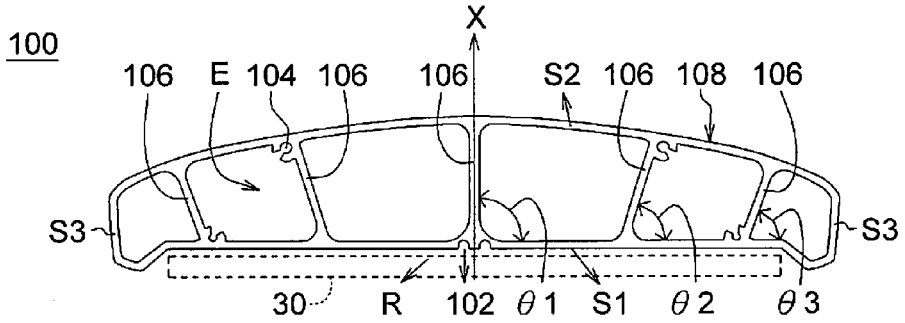
FIG. 2B shows a cross-section view of the housing in FIG. 2A along line 1-1 according to an embodiment of the present invention.

FIG. 2A shows a diagram illustrating a housing of a light emitting device according to an embodiment of the present invention. Referring to FIG. 2A, a housing 10 comprises a first part 100 and a second part 120. The first part 100 is used for accommodating a light emitting diode (Light Emitting Diode, LED) module 30 as shown in FIG. 2B and providing a space for heat dissipation. The second part 120 is used for accommodating electronic elements and electronic wires of the LED module 30.

The first part 100 has a first side 110*a* and a second side 110*b* opposite to the first side 110*a*. The first side 110*a* couples to a cover 110 and the second side 110*b* couples to the second part 120. A sunlight sensing element 122 can be disposed at the second part 120 for detecting the sunlight. When sufficient sunlight is detected by the sunlight sensing element 122, a power saving mode can be switched on for reducing the output power so that an effect of energy conservation can be achieved. In one embodiment, the second part 120 can be made from thermal conductive metal material, such as aluminum or copper.

FIG. 2B shows a cross-section view of the housing in FIG. 2A along line 1-1 according to an embodiment of the present invention. Please referring to FIGS. 2A and 2B, the first part 100 of the housing 10 comprises an outline casing 108 forming an enclosed room E. The outline casing 108 includes a light emitting side S1, a heat dissipating side S2 and two lateral sides S3. The first part 100 further comprises at least one heat conductive structure 106 disposed inside the enclosed room E. The heat conductive structure 106 couples to the light emitting side S1 and heat dissipating side S2 of the outline casing 108. The outline casing 108 is extended from the first side 110*a* to the second side 110*b* of the first part 100.

Referring to FIG. 2B, the outline casing 108 is dome shape or plate shape, and the heat dissipating side S2 of the outline casing 108 is arc-shape. The enclosed room E is formed of the outline casing 108, the cover 110 (shown in FIG. 2A) and the second part 120 (shown in FIG. 2A).

In this embodiment, the first part 100 comprises at least one heat conductive structure 106 and an outline casing 108. The heat conductive structures 106 are enclosed by the outline casing 108. The outline casing 108 can be flat shape or dome shape. The heat conductive structures 106 and the outline casing 108 are formed integrally by preventing aluminum intrusion. The outline casing 108 has a concave space R formed at the light emitting side S1 of the outline casing 108 with the circle curve shape or bended shape. The concave space R is defined and formed by the manufacturing molds at the same time the heat conductive structures 106 and the outline casing 108 are formed.

The LED module 30 can be disposed in the concave space R and attached to the light emitting side Si of the outline casing 108. By disposing the heat conductive structures 106 between the light emitting side S1 and the heat dissipating side S2 of the outline casing 108, the heat emitted by the LED module 30 can be conducted from the light emitting side S1 to the heat dissipating side S2 of the outline casing 108. Therefore, the heat dissipating side S2 of the outline casing 108 can exchange the heat generated from the LED module 30 with the outer environment. The heat dissipating side S2 of the outline casing 108 can be circle curve shape, for example, can prevent the accumulation of snow and rain.

In one embodiment, the heat conductive structures 106 and the outline casing 108 can be formed from metal materials, such as aluminum. The heat conductive structures 106 can connect the light emitting side S1 and the heat dissipating side S2 of the outline casing 108. In other words, the height of the heat conductive structures 106 can be the distance between the light emitting side S1 and the heat dissipating side S2 of the outline casing 108. Moreover, the length of the heat conductive structures 106 can be the distance between the first side 110*a* and the second side 110*b* of the first part 100. In other words, the heat conductive structures 106 can be extended from the first side 110*a* to the second side 110*b* of the first part 100. The cross section view of the heat conductive structure 106 can be flat shape, cross shape or net shape, and the invention is not limited thereto In FIG. 2B, the heat conductive structure 106 is shown as the flat shape for example.

In one embodiment, the number of the heat conductive structure 106 can be adjusted according to the manufacturing molds and/or the manufacturing requirements. The number of the heat conductive structure 106 is ranged from 1~10, including the upper limit value 10 and the lower limit value 1. The thickness of a wall of the outline casing 108 is ranged from 1 mm~10 mm, including the upper limit value 10 mm and the lower limit value 1 mm.

Besides, the heat conductive structures 106 disposed between the light emitting side S1 and the heat dissipating side S2 of the outline casing 108 are non-parallel and are outwardly diverged from the light emitting side S1 to the heat dissipating side S2 of the outline casing 108. The angles between above mentioned heat conductive structures 106 and the light emitting side S1 of the outline casing 108 are defined as angles θ1~θ3. The angles θ1~θ3 range from 45 degree to 90 degree, for example, including the lower limit value 45 degree and the upper limit value 90 degree.

In one embodiment, the angles θ1~θ3 between the heat conductive structures 106 and the light emitting side S1 of the outline casing 108 decrease gradually from a central axis X of the outline casing 108 to the lateral sides S3 of the outline casing 108. The outline casing 108 is symmetrical along the central axis X. In other words, the angles θ1~θ3 decrease gradually in a direction from the central of the outline casing 108 to the outside of the outline casing 108. For example, the angle θ1 is substantially 90 degree, the angle θ2 is substantially 60 degree and the angle θ3 is substantially 45 degree. The degrees of the angles are substantial values, and the values may include a manufacturing tolerance.

As shown in FIG. 2B, grooves 102 are disposed on the outer side of the light emitting side S1 of the outline casing 108 for accommodating electrical wires of the light emitting diode module 30. In one embodiment, there are two grooves 102 on the light emitting side Si of the outline casing 108 for accommodating the electrical wires of the LED module 30. The number of the grooves 102 is not restricted. In other embodiments, less or more grooves can be formed on the light emitting side Si of the outline casing 108. The depth of the grooves 102 can be related to the number of the electrical wires to be accommodated and the diameters of each electrical wires, and is not restricted thereto.

In one embodiment, a plurality of protruding parts with screw holes 104 are disposed at connecting portions between heat conductive structures 106 and the outline casing 108. The fixing elements (not shown) such as screws can fix the cover 110 (shown in FIG. 2A) onto the first side 110*a* of the first part 100. The cover 110 can prevent insects, rain, snow, dust and sand to enter the enclosed room E formed by the outline casing 108.

Based on the above, the at least one heat conductive structures 106 of the housing 10 disposed inside the enclosed room E can dissipate the heat to the outside environment uniformly by exchange the heat generated from the LED module, and the housing 10 is dust-proofed. In one embodiment, the circle curve shape of the heat dissipating side S2 of the outline casing 108 is artistic and can also prevent the accumulation of snow and rain.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A housing of light emitting device, comprising:

a first part for accommodating a light emitting diode module and providing a space for heat dissipation, the first part comprising an outline casing forming an enclosed room and at least one heat conductive structure disposed inside the enclosed room, wherein the outline casing includes a heat dissipating side, a light emitting side opposite to the heat dissipating side, and two lateral sides, wherein the heat dissipating side, the light emitting side and the two lateral sides form the enclosed room, and wherein the at least one heat conductive structure connects between the heat dissipating side and the light emitting side of the outline casing.

2. The housing according to claim 1, further comprising:

a second part coupling to the first part used for accommodating electronic elements of the light emitting diode module.

3. The housing according to claim 2, wherein the first part comprising a first side and a second side opposite to the first side, the second part is connected to the second side of the first part, and wherein the housing further comprising:

a cover for covering the first side of the first part.

4. The housing according to claim 1, wherein the first part comprises a plurality of heat conductive structures, wherein each of the heat conductive structures are disposed in non parallel relation with respect to one another inside the enclosed room and are outwardly diverged from the light emitting side to the heat dissipating side of the outline casing.

5. The housing according to claim 1, wherein the outline casing is dome shape or plat shape, the heat dissipating side of the outline casing is arc-shape.

6. The housing according to claim 1, wherein an outer side of the light emitting side comprising at least one groove for accommodating electrical wires of the light emitting diode module.

7. The housing according to claim 1, wherein the outline casing has a concave space formed at the light emitting side of the outline casing for accommodating the light emitting diode module.

8. The housing according to claim 1, further comprising:

a screw hole disposed at a connecting portion between the at least one heat conductive structure and the outline casing.

9. The housing according to claim 1, wherein the at least one heat conductive structure and the outline casing are formed integrally.

10. The housing according to claim 1, further comprising:

a sunlight sensing element for sensing sunlight.

11. A light emitting device, comprising:

a light emitting diode module for providing light; and a housing covering the light emitting diode module, the housing comprising a first part, the first part comprising an outline casing forming an enclosed room and at least one heat conductive structure disposed inside the enclosed room, wherein the outline casing includes a heat dissipating side, a light emitting side opposite to the heat dissipating side, and two lateral sides, wherein the heat dissipating side, the light emitting side and the two lateral sides form the enclosed room, and wherein the at least one heat conductive structure connects between the heat dissipating side and the light emitting side of the outline casing.

12. The light emitting device according to claim 11, further comprising:

a second part coupling to the first part used for accommodating electronic elements of the light emitting diode module.

13. The light emitting device according to claim 12, wherein the first part comprising a first side and a second side opposite to the first side, the second part is connected to the second side of the first part, and wherein the housing further comprising:

a cover for covering the first side of the first part.

14. The light emitting device according to claim 11, wherein the first part comprises a plurality of heat conductive structures, wherein each of the heat conductive structures are disposed in non parallel relation with respect to one another inside the enclosed room and are outwardly diverged from the light emitting side to the heat dissipating side of the outline casing.

15. The light emitting device according to claim 11, wherein the outline casing is dome shape or plat shape, the heat dissipating side of the outline casing is arc-shape.

16. The light emitting device according to claim 11, wherein an outer side of the light emitting side comprising:

at least one groove for accommodating electrical wires of the light emitting diode module.

17. The light emitting device according to claim 11, wherein the outline casing has a concave space formed at the light emitting side of the outline casing for accommodating the light emitting diode module.

18. The light emitting device according to claim 11, further comprising:

a screw hole disposed at a connecting portion between the at least one heat conductive structure and the outline casing.

19. The light emitting device according to claim 11, wherein the at least one heat conductive structure and the outline casing are formed integrally.

20. The light emitting device according to claim 11, further comprising:

a sunlight sensing element for sensing sunlight.

21. A light emitting device, comprising:

a light emitting diode module for providing light; and a housing covering the light emitting diode module, the housing comprising a first part, the first part comprising an outline casing forming an enclosed room and a plurality of heat conductive structures disposed inside the enclosed room, wherein each of the heat conductive structures are disposed in non parallel relation with respect to one another inside the enclosed room, wherein the outline casing includes a heat dissipating side, a light emitting side opposite to the heat dissipating side, and two lateral sides, and wherein all of the sides of the outline casing form the enclosed room.

22. The light emitting device according to claim 21, wherein the outline casing includes a heat dissipating side and a light emitting side, and each of the heat conductive structures connects the heat dissipating side and the light emitting side of the outline casing.

23. The light emitting device according to claim 21, wherein the outline casing includes a heat dissipating side and a light emitting side, and each of the heat conductive structures are outwardly diverged from the light emitting side to the heat dissipating side of the outline casing.

24. The light emitting device according to claim 21, wherein the outline casing includes a heat dissipating side, a light emitting side opposite to the heat dissipating side, and two lateral sides, wherein all of the sides of the outline casing form the enclosed room.

* * * * *